US009840934B2

(12) United States Patent
Christians

(10) Patent No.: US 9,840,934 B2
(45) Date of Patent: Dec. 12, 2017

(54) AERO-ACTUATED VANES

(71) Applicant: UNITED TECHNOLOGIES CORPORATION, Farmington, CT (US)

(72) Inventor: Joseph T. Christians, Vernon, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 345 days.

(21) Appl. No.: 14/552,106

(22) Filed: Nov. 24, 2014

(65) Prior Publication Data

US 2016/0010486 A1 Jan. 14, 2016

Related U.S. Application Data

(60) Provisional application No. 61/914,741, filed on Dec. 11, 2013.

(51) Int. Cl.
*F01D 17/16* (2006.01)

(52) U.S. Cl.
CPC ..... *F01D 17/162* (2013.01)

(58) Field of Classification Search
CPC ..... F01D 17/162
USPC ..... 415/160
See application file for complete search history.

(56) References Cited

U.S. PATENT DOCUMENTS 4,695,220 A * 9/1987 Dawson ..... F01D 17/162 415/156
5,044,879 A * 9/1991 Farrar ..... F04D 29/563 415/150
5,380,152 A * 1/1995 Sikorski ..... B29D 99/0025 415/160
6,677,844 B1 * 1/2004 Gorospe ..... H01F 7/16 335/220
7,112,041 B2 * 9/2006 Debeneix ..... F01D 17/162 415/160
8,052,373 B2 * 11/2011 Bolgar ..... F01D 17/162 415/30
8,172,517 B2 * 5/2012 Lighty ..... F01D 17/162 415/156
2010/0107600 A1 * 5/2010 Hillel ..... F01D 17/08 60/235
2012/0023901 A1 * 2/2012 Gilson ..... F02K 1/09 60/226.3
2012/0321448 A1 * 12/2012 Pesyna ..... F02K 3/077 415/145
2013/0084179 A1 * 4/2013 Mantese ..... F01D 17/162 416/1

* cited by examiner

*Primary Examiner* — Woody Lee, Jr.
*Assistant Examiner* — Eric Zamora Alvarez
(74) *Attorney, Agent, or Firm* — Cantor Colburn LLP

(57) ABSTRACT

A turbomachinery vane includes a vane body defining a longitudinal axis, a trunnion extending from the vane body and defining a pivot point for pivoting the vane body about the longitudinal axis, and a lock system operatively connected to the trunnion and configured to lock the vane body in a plurality of locked positions. A gas turbine engine includes a turbomachinery component including a row of actuated stators, wherein the actuated stator row includes a plurality of the turbomachinery vanes. A method of actuating a vane by aerodynamic loads includes moving the vane about a pivot point from a first position to a second position by a first set of by aerodynamic loads.

18 Claims, 4 Drawing Sheets

AERO-ACTUATED VANES

CROSS-REFERENCE TO RELATED APPLICATION

This application claims the benefit of priority under 35 U.S.C. §119(e) to U.S. Provisional Application No. 61/914,741, filed Dec. 11, 2013, which is incorporated herein by reference in its entirety.

BACKGROUND OF THE INVENTION

1. Field of the Invention

This invention relates generally to gas turbine engines and more particularly to stator vane actuation for such engines.

2. Description of Related Art

The compressor and the turbine sections of a gas turbine engine typically both include a series of rotor blade and stator vane stages. Stators serve generally two purposes: they convert the kinetic energy of the air into pressure, and they direct the trajectory of the air relative to an adjacent rotor. Turbine stators can change the flow metering area, thereby changing the flow capacity of the turbine, which can be employed to a favorable effect in engine performance. Variable stator vanes are one way of achieving more efficient performance of the gas turbine engine over the entire speed range. These variable stator vanes can optimize the incidence of the airflow onto subsequent stage rotors for a given level of speed within a range.

Variable stator vanes are typically circumferentially arranged between an outer diameter case and an inner diameter vane shroud. Conventional vane actuation systems use various mechanisms to rotate the individual stator vanes in response to an external actuation source, such as kinematic motion of the levers, unison rings, or actuation beams.

Such conventional methods and systems have generally been considered satisfactory for their intended purpose. However, there is still a need in the art for improved vane actuations, e.g., which reduce complexity and weight for gas turbine engines. The present disclosure provides a solution for these problems.

SUMMARY OF THE INVENTION

A turbomachinery vane includes a vane body defining a longitudinal axis. A trunnion is included, extending from the vane body and defining a pivot point for pivoting the vane body about the longitudinal axis. A lock system is operatively connected to the trunnion and configured to lock the vane body in a plurality of locked positions. The lock portion can include a first stop at a first locked position and a second stop at a second locked position. The vane body can include a leading edge, an opposed trailing edge, a high pressure side, and an opposed low pressure side, with the trunnion located at a position relative to the leading edge, trailing edge, high pressure side, and low pressure side for aerodynamic loads to pivot the vane body. In certain embodiments, the trunnion is located at a position relative to the leading edge, trailing edge, high pressure side, and low pressure side for a first set of aerodynamic loads pivot the vane body from the first locked position to the second locked position and a second set of aerodynamic loads pivot the vane body from the second locked position to the first locked position.

The lock system can be configured to release the vane body from one of the first and second locked positions when changing flow mode conditions to pivot the vane body, and can be configured to re-engage the vane body after changing flow mode conditions have pivoted the vane body to the other of the first and second locked positions. The lock system can be configured to release the vane body between the first and the second locked positions for actuation of vane body movement by aerodynamic loading. In accordance with certain embodiments, the lock system includes at least one of a solenoid-type mechanism. In certain embodiments, the lock system includes a magnetic latch.

A gas turbine engine includes a turbomachinery component including a row of actuated stators. The row of actuated stators includes a plurality of vanes. Each of the vanes includes a vane body defining a longitudinal axis, a trunnion extending from the vane body and defining a pivot point for pivoting the vane body about the longitudinal axis, and a lock system operatively connected to the trunnion and configured to lock the vane body in a plurality of locked positions.

In accordance with certain embodiments, the turbomachinery component is a turbine, and the actuated stator row can be a turbine vane row. It is also contemplated that in certain embodiments, the turbomachinery component is a compressor, and the actuated stator row can be a compressor vane row, or the turbomachinery component can be a fan inlet or exit guide vane, for example.

A method of actuating a vane by aerodynamic loads includes moving the vane about a pivot point from a first position to a second position by a first set of aerodynamic loads and moving the vane about the pivot point from the second position to the first position by a second set of aerodynamic loads. The method can include releasing a lock system of the vane and re-engaging the lock system of the vane. The method can include moving the vane about a pivot point from the first position to the second position by a second set of aerodynamic loads.

In certain embodiments, the method includes alternating operating conditions to produce aerodynamic loads to move the vane. Alternating operating conditions can include adjusting a variable nozzle area, adjusting a third stream nozzle flow, moving a throttle position, or the like.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
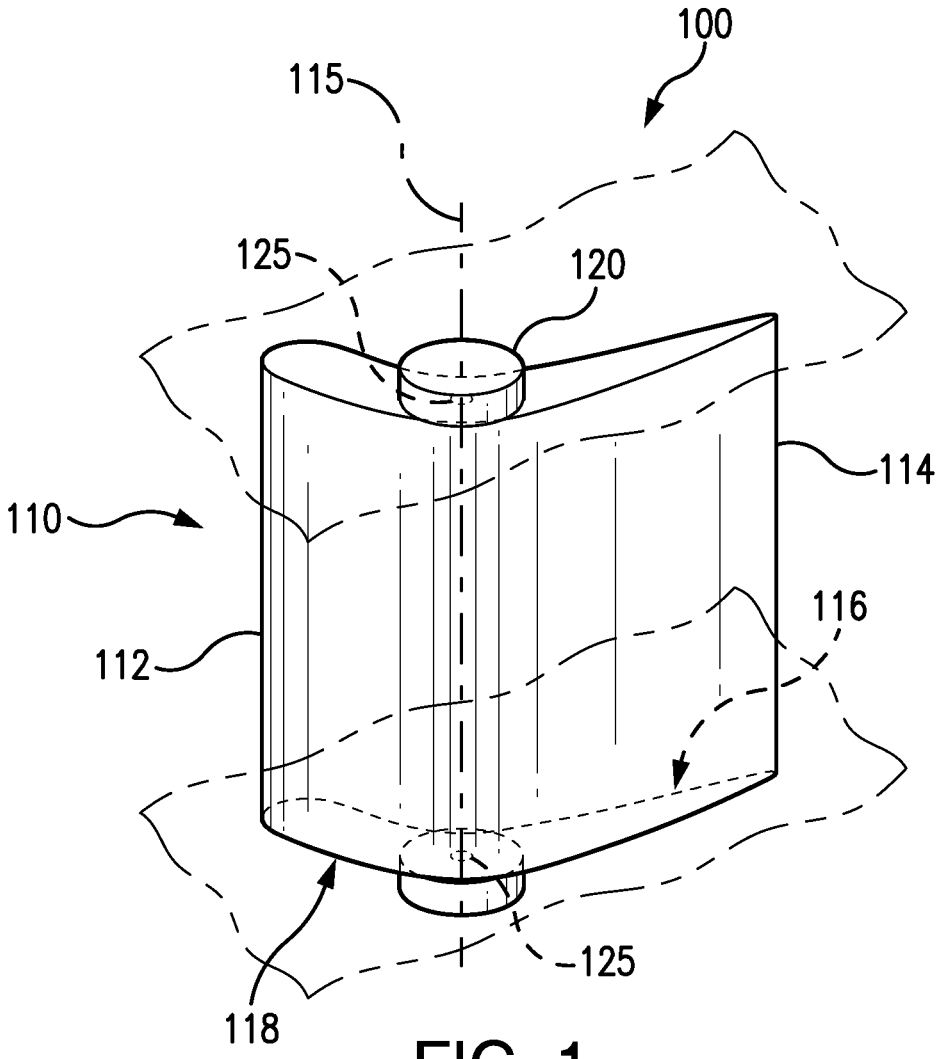
FIG. 1 is a schematic perspective view of an exemplary embodiment of a turbomachinery vane in accordance with the present disclosure.

Reference will now be made to the drawings wherein like reference numerals identify similar structural features or aspects of the subject disclosure. For purposes of explanation and illustration, and not limitation, a partial view of an exemplary embodiment of a turbomachinery vane in accordance with the disclosure is shown in FIG. 1 and is designated generally by reference character 100. Other embodiments of turbomachinery vanes in accordance with the disclosure, or aspects thereof, are provided in FIGS. 2A, 2B, and 3, as will be described. The systems and methods described herein can be used to provide an actuated vane, such as in turbomachinery vanes of gas turbine engines.

FIG. 1 schematically illustrates an example of a turbomachinery vane 100 including a vane body 110 defining a longitudinal axis 115. The vane body 110 includes a leading edge 112, an opposed trailing edge 114, a high pressure side 116, and an opposed low pressure side 118. A trunnion 120 extends from the vane body 110 and defines a pivot point 125 for pivoting the vane body 110 about the longitudinal axis 115. As shown in FIG. 1, the trunnion 120 extends from both ends of the vane body 110. The pivot point 125 is positioned on the vane body 110 such that aerodynamic twisting moments on the vane body 110 change direction at different operating conditions. In other words, aerodynamic loads actuate the vane body 110 without the need for a mechanical actuator. To this end, the trunnion 120 is located at a position relative to the leading edge 112, trailing edge 114, high pressure side 116, and low pressure side 118 for aerodynamic loads to pivot the vane body 110. In particular, the trunnion 120 is located at a position for a first set of aerodynamic loads to pivot the vane body 110 from a first locked position to a second locked position and for a second set of aerodynamic loads to pivot the vane body 110 from the second locked position to the first locked position.

Figure 2A:
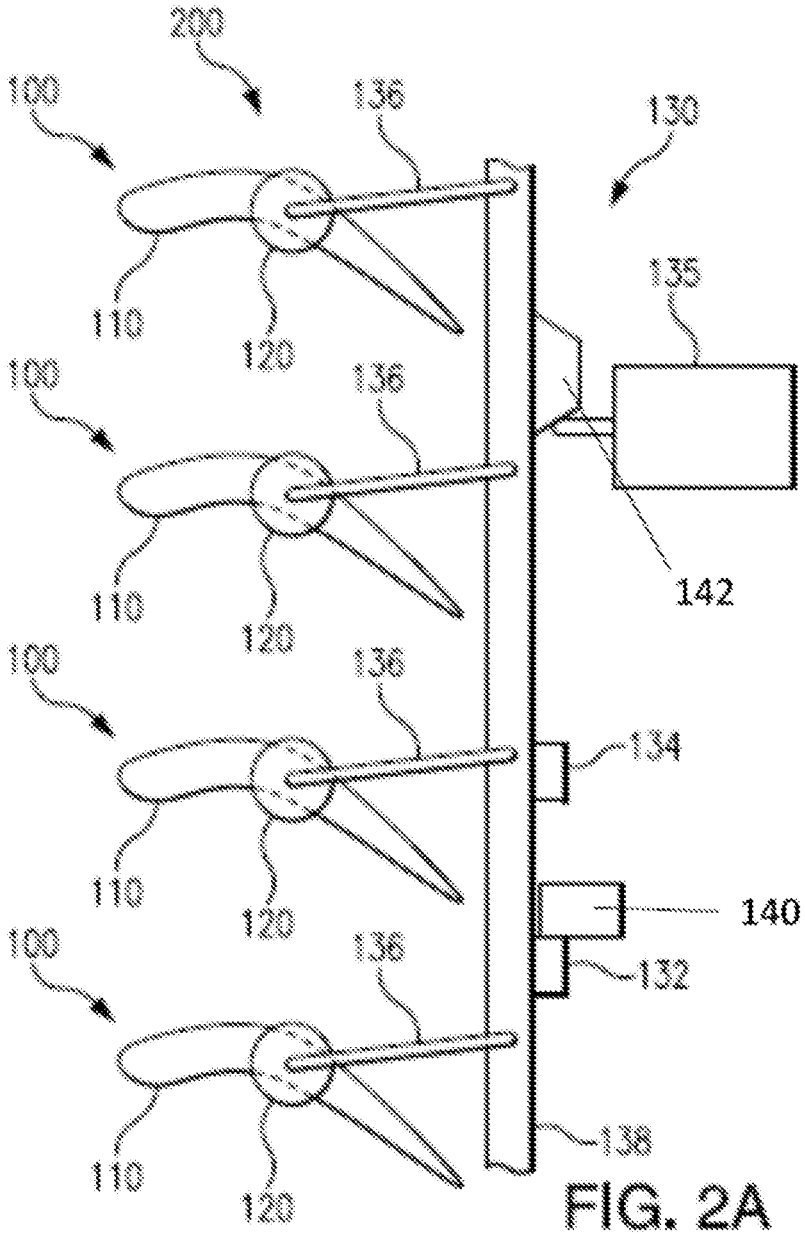
FIGS. 2A and 2B are schematic perspective views of turbomachinery vanes in a stator row, showing a first position and a second position, respectively.
Figure 2B:
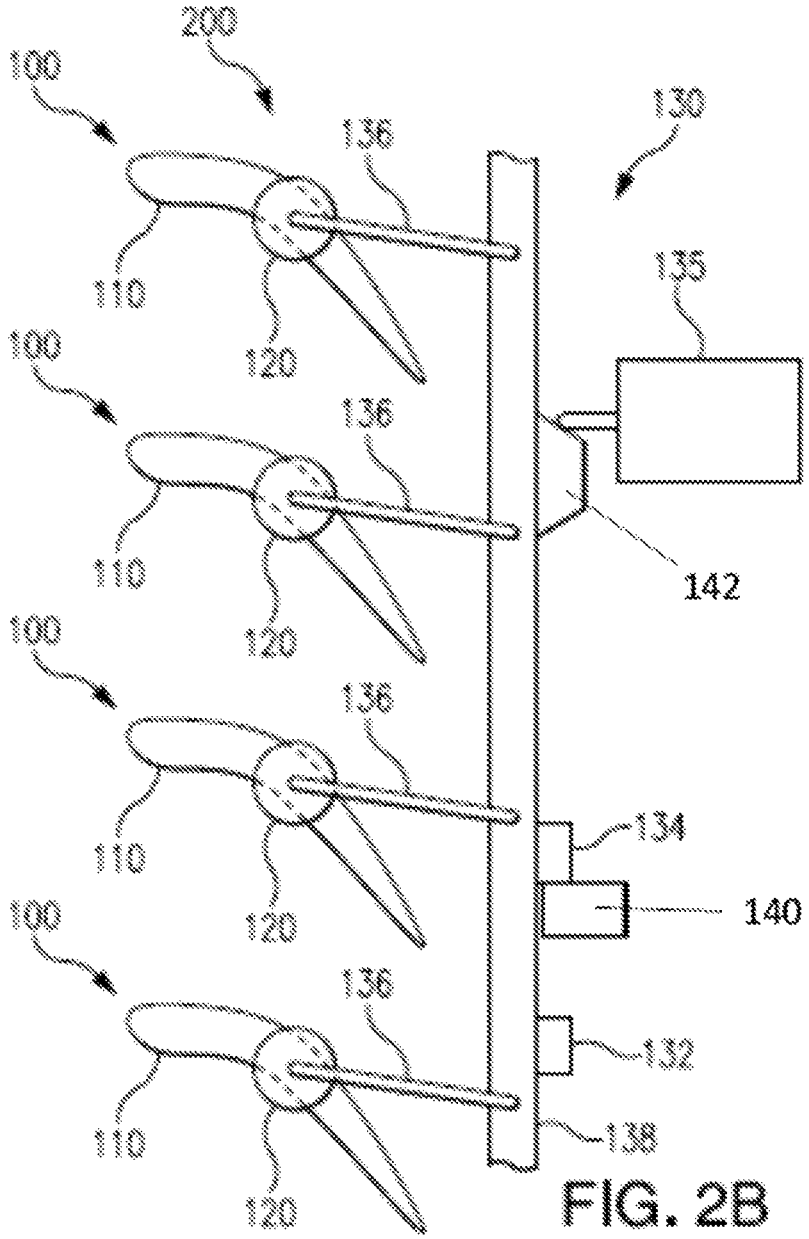

FIGS. 2A and 2B schematically illustrate perspective views of turbomachinery vanes in a stator row 200 showing a first locked position and a second locked position, respectively. A lock system 130 is operatively connected to the trunnions 120 of each of the vane bodies 110. A locking member, e.g., a crank arm 136 as shown in FIGS. 2A and 2B, is attached to each of the respective trunnions 120. A sync ring 138 connects each of the crank arms 136 such that the vane bodies 110 along the stator row 200 are actuated uniformly. The lock system 130 includes a first stop 132 at the first locked position and a second stop 134 at the second locked position. Thus the turbomachinery vanes 100 operate as two-position mechanisms by means of the first stop 132 and second stop 134, with the lock system 130 holding the vane body 110 in place against one of the two stops.

The lock system 130 is configured to release the vane body 110 between the first and the second locked positions for actuation of vane body movement by aerodynamic loading. The lock system 130 is also configured to release the vane body 110 from one of the first and second locked positions when changing flow mode conditions to pivot the vane body 110 and to re-engage the vane body 110 after the vane body 110 has pivoted to a desired position. In particular, when changing from a first "flow mode" to a second "flow mode" or vice-versa, the lock system 130 is released and aerodynamic loads move the vane body 110 to the other position and the lock system 130 is subsequently re-engaged. As shown in FIGS. 2A and 2B, the lock system 130 includes a solenoid-type mechanism 135 capable of engaging and disengaging the lock system 130. The solenoid-type mechanism 135 retracts to allow the vane body 110 to move to another position, and as aerodynamic loads move the vane body 110 to the locked position, the solenoid 135 is re-engaged to hold the position. The lock system 130 can include a magnetic latch, e.g. with electromagnets embedded in the stops 132 and 134. Crank arms 136, as shown in FIGS. 2A and 2B, are an example of a lock member and any other suitable lock member can be used. Embodiments with two locking positions are illustrated in FIGS. 2A and 2B, however, the turbomachinery vane in accordance with the present disclosure can include any number of locked positions, defined at selected rotational points about the trunnion.

Figure 3:
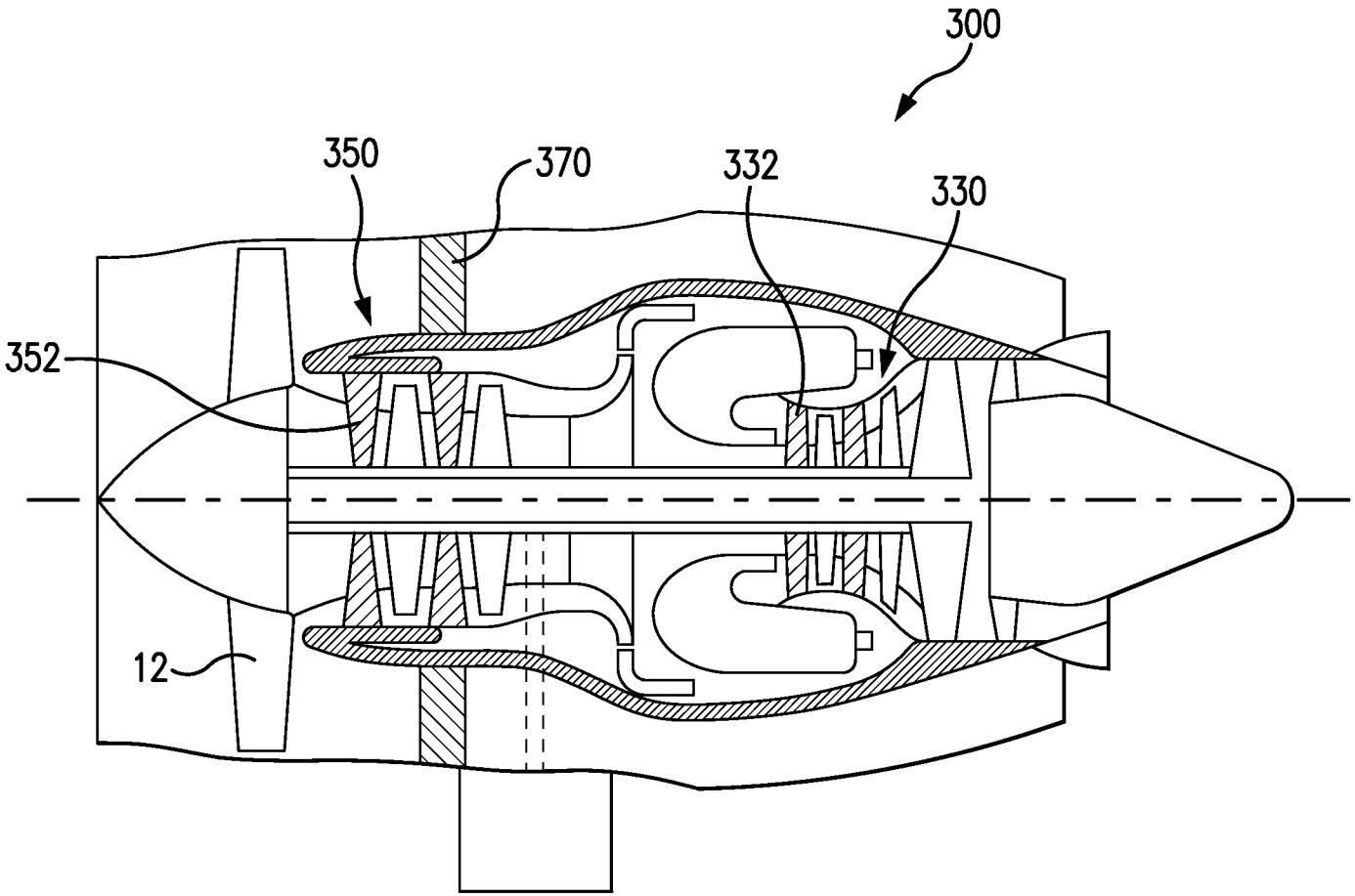
FIG. 3 is a cross-sectional side elevation view of a gas turbine engine in accordance with the present disclosure.

A gas turbine engine 300 is shown in FIG. 3. The gas turbine engine 300 includes various turbomachinery components with rows of actuated stators, where each of the rows of actuated stators can include a plurality of turbomachinery vanes as described above. With continued reference to FIG. 3, a turbine 330 is a turbomachinery component, and a turbine vane row 332 can be an actuated stator row as described above. Similarly, the compressor 350 is a turbomachinery component with the compressor vane row 352 being an actuated stator row as described above. A fan guide vane 370 is also a turbomachinery component that can be an actuated stator row as described above.

A method of actuating a vane body, e.g., the vane body 110, by aerodynamic loads includes moving the vane body about a pivot point, e.g., the pivot point 125, from a first position (e.g., as shown in FIG. 2A) to a second position (e.g., as shown in FIG. 2B) by a first set of aerodynamic loads and moving the vane body about the pivot point from the second position to the first position by a second set of aerodynamic loads. The method can include releasing and re-engaging a lock system, e.g. the lock system, 130.

If the net moment produced by the aerodynamic loads is not in the desired direction at a certain operating condition, then the gas turbine engine 300 can be briefly operated at an alternate condition (preferably at the same thrust) to produce the right loads to actuate the vane body 110. After the vane body 110 has been moved to the desired position, the gas turbine engine 300 can return to the intended operating condition. Alternating an operating condition is accomplished using other adaptive features in the engine, and can include adjusting a variable nozzle area, adjusting a third stream nozzle flow, moving the throttle position, or the like.

The methods and systems of the present disclosure, as described above and shown in the drawings, provide for an actuated turbomachinery vane with superior properties including reduced complexity and weight. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A turbomachinery vane system comprising:

a plurality of vanes, each vane including:

a vane body defining a longitudinal axis; and a trunnion extending from the vane body and defining a pivot point for pivoting the vane body about the longitudinal axis;

a sync ring to which each vane of the plurality of vanes is operably connected; and a lock system including:

a first stop disposed at the sync ring engagable with a retaining member when the plurality of vanes are subjected to a first set of aerodynamic loads; and a second stop disposed at the sync ring engagable with the retaining member when the plurality of vanes are subjected to a second set of aerodynamic loads;

the lock system operatively connected to the trunnion and configured to lock the vane body in a plurality of locked positions;

the lock system configured to release the vane body between a first locked position and a second locked position of the plurality of locked positions for actuation of vane body movement by aerodynamic loading.

2. A turbomachinery vane system as recited in claim 1, wherein the vane body includes a leading edge, an opposed trailing edge, a high pressure side, and an opposed low pressure side, and the trunnion is located at a position relative to the leading edge, the trailing edge, the high pressure side, and the low pressure side for aerodynamic loads to pivot the vane body.

3. A turbomachinery vane system as recited in claim 2, wherein the trunnion is located at a position relative to the leading edge, the trailing edge, the high pressure side, and the low pressure side for a first set of aerodynamic loads to pivot the vane body from the first locked position to the second locked position and a second set of aerodynamic loads to pivot the vane body from the second locked position to the first locked position.

4. A turbomachinery vane system as recited in claim 1, wherein the lock system is configured to release the vane body from one of the first locked position or the second locked position when changing flow mode conditions to pivot the vane body.

5. A turbomachinery vane system as recited in claim 4, wherein the lock system is configured to re-engage the vane body after changing flow mode conditions have pivoted the vane body to the first locked position or the second locked positions.

6. A turbomachinery vane system as recited in claim 1, wherein the lock system includes a solenoid-type mechanism capable of engaging and disengaging the lock system.

7. A turbomachinery vane system as recited in claim 1, wherein the lock system includes a magnetic latch.

8. A gas turbine engine comprising:

a turbomachinery component including a row of actuated stators;

wherein the row of actuated stators includes:

a plurality of vanes, at least one of the vanes comprising:

a vane body defining a longitudinal axis; and a trunnion extending from the vane body and defining a pivot point for pivoting the vane body about the longitudinal axis;

a sync ring to which each vane of the plurality of vanes is operably connected; and a lock system including a first stop disposed at the sync ring engagable with a retaining member when the plurality of vanes are subjected to a first set of aerodynamic loads; and a second stop disposed at the sync ring engagable with the retaining member when the plurality of vanes are subjected to a second set of aerodynamic loads;

the lock system operatively connected to the trunnion and configured to lock the vane body in a plurality of locked positions;

the lock system configured to release the vane body between a first locked position and a second locked position of the plurality of locked positions for actuation of vane body movement by aerodynamic loading.

9. A gas turbine engine as recited in claim 8, wherein the turbomachinery component is a turbine.

10. A gas turbine engine as recited in claim 9, wherein the actuated stator row is a turbine vane row.

11. A gas turbine engine as recited in claim 8, wherein the turbomachinery component is a compressor.

12. A gas turbine engine as recited in claim 11, wherein the actuated stator row is a compressor vane row.

13. A gas turbine engine as recited in claim 8, wherein the turbomachinery component is a fan guide vane.

14. A method of actuating a turbomachinery vane by aerodynamic loads comprising:

moving the vane about a pivot point from a first position to a second position by a first set of aerodynamic loads; and moving the vane about the pivot point from the second position to the first position by a second set of aerodynamic loads;

locking the vane at the first position via engagement of a first stop of a sync ring with a lock system;

locking the vane at the second position via engagement of a second stop of the sync ring with the lock system; and releasing the vane from the first position and the second position for actuation of vane movement by aerodynamic loading.

15. A method as recited in claim 14, further comprising:

releasing the lock system on the vane; and re-engaging the lock system on the vane.

16. A method as recited in claim 14, further comprising alternating operating conditions to produce aerodynamic loads to move the vane.

17. A method as recited in claim 16, wherein alternating operating conditions includes adjusting a variable nozzle area.

18. A method as recited in claim 16, wherein alternating operating conditions includes adjusting a third stream nozzle flow.

* * * * *